US006734831B2

(12) United States Patent
Makino

(10) Patent No.: US 6,734,831 B2
(45) Date of Patent: May 11, 2004

(54) DUAL-RESONANCE ANTENNA

(75) Inventor: Mitsuya Makino, Warabi (JP)

(73) Assignee: Nippon Antena Kabushiki Kaisha, Tokyo (JP)

( * ) Notice: Subject to any disclaimer, the term of this patent is extended or adjusted under 35 U.S.C. 154(b) by 11 days.

(21) Appl. No.: 10/169,572

(22) PCT Filed: Oct. 18, 2001

(86) PCT No.: PCT/JP01/09155

§ 371 (c)(1),
(2), (4) Date: Jul. 5, 2002

(87) PCT Pub. No.: WO02/47203

PCT Pub. Date: Jun. 13, 2002

(65) Prior Publication Data

US 2002/0190916 A1 Dec. 19, 2002

(30) Foreign Application Priority Data

Dec. 6, 2000 (JP) ..... 2000-371218

(51) Int. Cl.[7] ..... H01Q 1/36
(52) U.S. Cl. ..... 343/895
(58) Field of Search ..... 343/895, 702, 343/860, 850, 853, 749

(56) References Cited

U.S. PATENT DOCUMENTS 6,016,130 A * 1/2000 Annamaa ..... 343/895
6,054,966 A * 4/2000 Haapala ..... 343/895
6,112,102 A * 8/2000 Zhinong ..... 455/550
6,201,500 B1 * 4/2001 Zurfluh ..... 343/702

FOREIGN PATENT DOCUMENTS

| | | | |
|---|---|---|---|
| JP | 63-286008 | 11/1988 | ..... H01Q/5/00 |
| JP | 09-139618 | 5/1997 | ..... H01Q/1/24 |
| JP | 2000-013278 | 1/2000 | ..... H04B/1/40 |
| JP | 2000-059130 | 2/2000 | ..... H01Q/5/01 |

OTHER PUBLICATIONS

International Search Report, PCT/JP01/09155 Jan. 8, 2002, pp. 1.

* cited by examiner

*Primary Examiner*—Hoang V Nguyen
(74) *Attorney, Agent, or Firm*—Connolly, Bove & Lodge & Hutz LLP; Larry J. Hume

(57) ABSTRACT

With the object of reducing the size, without degrading the electric characteristics, a first coil 21 and a second coil 23 that are helically wound are provided, and a connection member 22 is provided which is obtained by bending the upper end portion of the first coil 21 downward and passing it inside the first coil 21 substantially along the central axis of the first coil 21. The lower end portion of the connection member 22 is connected to the upper end of the second coil 23, and power is supplied from a feeder 24 to the lower end portion of the second coil 23.

5 Claims, 10 Drawing Sheets

DUAL-RESONANCE ANTENNA

CROSS-REFERENCE TO RELATED APPLICATIONS

This application is a National Stage Entry under 35 U.S.C. §371 of International Application PCT/JP01/09155, filed on Oct. 18, 2001, and which claims priority to Japanese patent application 2000-371218, filed on Dec. 6, 2000, the entire contents of each of which are incorporated herein by reference.

TECHNICAL FIELD

The present invention relates to a dual-resonance antenna that can be used in two mutually separated frequency bands employed in cellular phones or handyphones (PHS: personal handyphone system).

BACKGROUND ART

The number of cellular phone or PHS subscribers increases from year to year, and because of such an increase in the number of subscribers, the employed frequency is insufficient. When the employed frequency is insufficient because of such an increase in the number of subscribers, two frequency bands are allocated: a frequency band that can be used almost everywhere as the frequency band of cellular phones and a frequency band that can be used in cities. For example, in Europe, cellular phones of a GSM system with a 900 MHz band can be used everywhere, and also cellular phones of DCS system with a 1.8 GHz can be used in cities in order to compensate for the utilized frequency insufficiency. For a cellular phone to be thus used in two frequency bands, it has to be made suitable for operation in two frequency bands. Thus, it has to contain wireless circuitry for each frequency band of the two frequency bands and to be provided with a dual-resonance antenna operating in two frequency bands.

A dual-resonance antenna shown in FIG. 9 has been suggested as the dual-resonance antenna of such type. This dual-resonance antenna comprises a helically wound coil 121 and a connection member 122 obtained by bending the upper end portion of the coil 121 downward and passing it inside the coil 121 almost along the central axis of coil 121. Power is fed from a feeder 124 to the end portion of the connection member 122.

An equivalent circuit of dual-resonance antenna 114 shown in FIG. 9 is shown in FIG. 10. As shown in FIG. 10, the coil 121 and connection member 122 passing inside the coil 121 are high-frequency coupled, a floating capacitance is generated, and a parallel resonant circuit comprising an inductor L101 and a capacitor C101 is equivalently formed. An equivalent element 125 is equivalently formed above this parallel resonant circuit, and an equivalent element 126 is equivalently formed between the parallel resonant circuit and feeder 124. The equivalent element 125 is formed by the coil 121, and the equivalent element 126 is formed by the connection member 122.

In such a dual-resonance antenna 114, the coil 121 together with the connection member 122 operate as an antenna in a low-frequency band (first frequency band), the parallel resonant circuit is caused to operate as a trap in a high-frequency band (second frequency band), and the connection member 122 operates as an antenna at a high frequency. Thus, the dual-resonance antenna 114 operates at two frequency bands, namely first and second frequency bands.

In such a dual-resonance antenna, the antenna operating in a high-frequency band is formed by a linear connection member 122. Therefore, the length of connection member 122 has to correspond to the frequency of the second frequency band. The problem, however, is that if the length of connection member 122 is selected so as to correspond to the frequency of the second frequency band, the length of dual-resonance antenna 114 is increased and the size of antenna is difficult to reduce. For this reason, the size reduction of dual-resonance antenna 114 operating in two frequency bands, first frequency band and second frequency band, was attained by decreasing the length of connection member 122 to a level less than that essentially required and connecting a matching circuit with a dual-resonance characteristic. FIG. 11 shows a VSWR characteristic of dual-resonance antenna 114 with a total length reduced to about 20 mm, which has such a matching circuit connected thereto. In the VSWR characteristic shown in FIG. 11, frequency is plotted against the abscissa, a 900 MHz band (890–960 MHz) in the GSM (global system for mobile communication) is a first frequency band, and a 1.7 GHz band (1710–1880 MHz) in a DCS (Digital Cellular System) is a second frequency band. As shown in FIG. 11, the worst value of VSWR in the first frequency band is 3.1, the worst value of VSWR in the second frequency band is 2.7, and good VSWR is not obtained.

Furthermore, in the VSWR characteristic shown in FIG. 11, the matching circuit shown in FIG. 12 is connected between the dual-resonance antenna 114 and feeder 124. In order to obtain a dual-resonance characteristic, this matching circuit is composed by connecting a second inductor L112 and a third inductor L113 in series, connecting a capacitor C111 between the ground and the connection point of the second inductor L112 and the third inductor L113, and connecting the first inductor L111 between the ground and the initial end of the second inductor L112. In this case, the first inductor L111 is about 15 nH, the second inductor L112 and third inductor L113 are about 4.7 nH, and the capacitor C111 is about 2 pF. Thus, the problem was that the dual-resonance antenna 114 required a complex matching circuit using four or more elements.

Accordingly, it is an object of the present invention to provide a dual-resonance antenna that can be miniaturized without degrading the electric characteristics and that employs a simple matching circuit.

DISCLOSURE OF THE INVENTION

In order to attain this object, the dual-resonance antenna in accordance with the present invention comprises a first coil, a connection member obtained by bending an end portion of the first coil and passing it along almost the central axis inside the first coil, and a second coil connected to the end portion of the connection member.

Furthermore, in the dual-resonance antenna in accordance with the present invention, a first reactance element for matching may be connected in series between the end portion of said second coil and a feeder, and a second reactance element for matching may be connected between the end portion of said second coil and the ground.

Moreover, in the dual-resonance antenna according to the present invention described in the above, a π-type matching circuit or a T-type matching circuit composed of a third reactance element may be connected between the end portion of the second coil and a feeder.

In accordance with the present invention, since the second coil is connected to the end portion of the connector member passed along almost the central axis inside the first coil, the total length of the dual-resonance antenna can be reduced and the antenna can be miniaturized. Furthermore, despite the size reduction, the second coil with an inherently required length can be used. As a result, a dual-resonance antenna with good electric characteristics can be obtained. Furthermore, since a matching circuit providing a dual-resonance characteristic is not required, a simple circuit with a small number of components can be used as the matching circuit for feeding the dual-resonance antenna.

BEST MODE OF CARRYING OUT THE INVENTION

Figure 1:
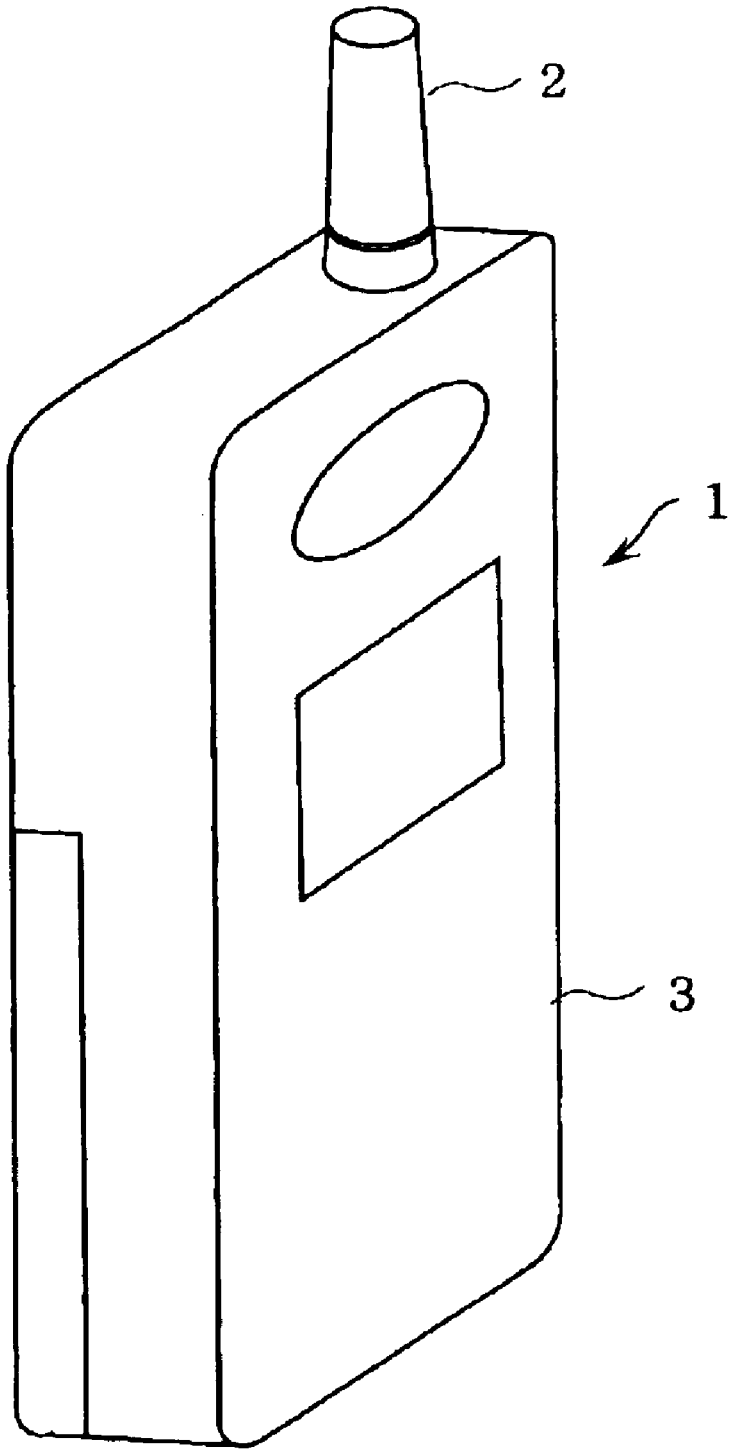
FIG. 1 illustrates an example of configuration in which the antenna unit which is a dual-resonance antenna of an embodiment of the present invention is installed on a wireless device housing.

An example of configuration in which the antenna unit which is a dual-resonance antenna of an embodiment of the present invention is installed on a wireless device housing is shown in FIG. 1. The wireless device housing is, for example, a housing of a cellular phone.

An antenna unit 2 is installed on top of a wireless device housing 3 of a cellular wireless device 1 shown in FIG. 1. The antenna unit 2 is a dual-resonance antenna operating in two frequency bands. The two frequency bands are, for example, a 800 MHz band (810 MHz–956 MHz) in a PDC (Personal Digital Cellular telecommunication system) system and a 1.4 GHz band (1429 MHz–1501 MHz), or 800 MHz (890 MHz–960 MHz) band of a GSM (Global System for Mobile communications) system and a 1.7 GHz band (1710 MHz–1880 MHz) of a DCS (Digital Cellular System) system.

Figure 2:
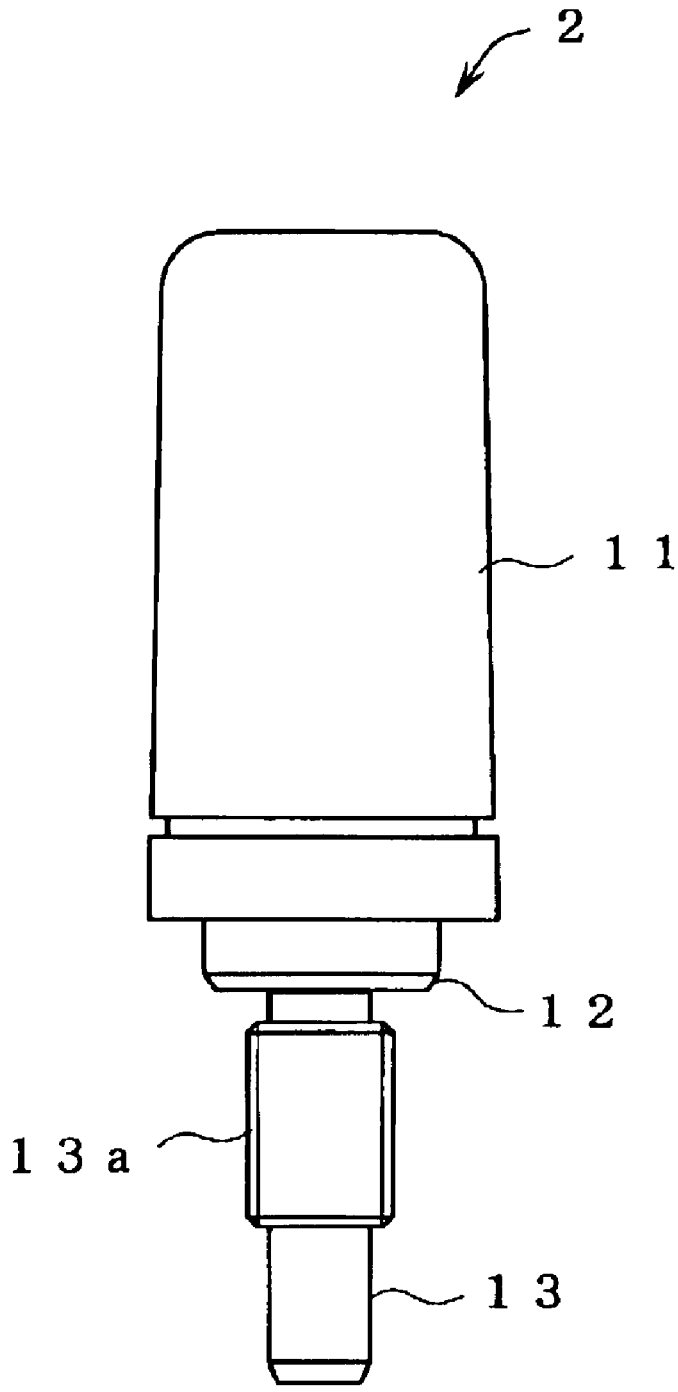
FIG. 2 illustrates an external appearance of the antenna unit which is a dual-resonance antenna of an embodiment of the present invention.

An example of the external appearance and configuration of such an antenna unit 2 is shown in FIG. 2.

As shown in FIG. 2, the antenna unit 2 of the dual-resonance antenna in accordance with the present invention is assembled by screwing a base fitting 12 into an opening of a cylindrical antenna cover unit 11 closed at one end. The antenna cover unit 11 is fabricated by resin molding, and the below-described dual-resonance element 14 is enclosed therein. Furthermore, the lower end portion of dual-resonance element 14 is connected to the base fitting 12. A thin rod-like mounting member 13 is formed in an extended condition from the lower end of base fitting 12. A threaded portion 13*a* is formed in the middle of mounting member 13. The antenna unit 2 is secured to the wireless device housing 3 by inserting the mounting member 13 into the mounting hole provided in the wireless device housing 3 and screwing the threaded portion 13*a* into the mounting hole.

Figure 3:
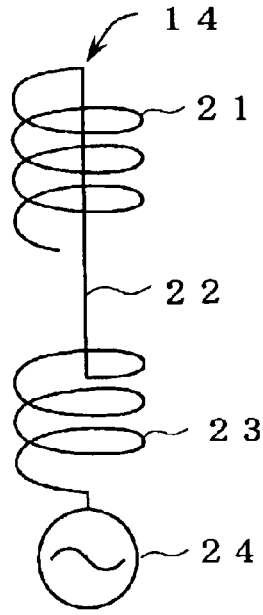
FIG. 3 illustrates a schematic configuration of the antenna unit which is a dual-resonance antenna of an embodiment of the present invention.

The configuration of the dual-resonance element 14 enclosed in the antenna cover unit 11 is schematically shown in FIG. 3.

The dual-resonance element 14 comprises a first coil 21 and a second coil 23 that are helically wound. The upper end portion of the first coil 21 is bent downward forming a connection member 22 passing through the first coil 21 almost along the central axis of the first coil 21. The lower end portion of connection member 22 is connected to the upper end portion of the second coil 23, and power is fed to the lower end portion of the second coil 23 from a feeder 24. Such a dual-resonance element 14 is prepared by coil-like winding of one wire, as shown in FIG. 3.

Figure 4:
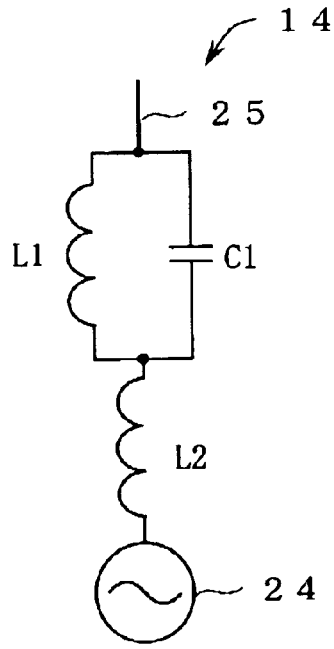
FIG. 4 is an equivalent circuit of the antenna unit which is a dual-resonance antenna of an embodiment of the present invention.

An equivalent circuit of the dual-resonance element 14 shown in FIG. 3 is shown in FIG. 4. The first coil 21 and the connection member 22 passing inside the first coil 21 are high-frequency coupled and a floating capacitance is generated. As a result, as shown in FIG. 4, an equivalent parallel resonant circuit of a first inductor L1 and a capacitor C1 is formed. An equivalent element 25 composed of and equivalently formed by the first coil 21 is connected to the parallel resonant circuit, and a second inductor L2 equivalently formed by the second coil 23 is connected between the parallel resonant circuit and feeder 24.

In such a dual-resonance element 14, the first coil 21 and the connection member 22 together with the second coil 23 operate as an antenna in a low-frequency band (first frequency band). Further, if the parallel resonant circuit is set so as to operate as a trap in a high-frequency band (second frequency band), the second coil 23 will operate as an antenna in a high-frequency band (second frequency band). As a result, the dual-resonance element 14 can operate in two frequency bands, that is, the first frequency band and the second frequency band.

In this case, in the first, low frequency band, the first coil 21 and second coil 23 operate as loading coils. Therefore, the length of the entire dual-resonance element 14 can be decreased and the element can be miniaturized. Furthermore, in the second, high frequency band, the second coil 23 operates as a loading coil. Therefore, the physical length obtained by adding the lengths of the connection member 22 and second coil 23 can be decreased and the dual-resonance element 14 can be miniaturized. Thus, even when the size is decreased, the electric length of connection member 22 and second coil 23 can be made an inherently necessary electric length and good electric characteristics of dual-resonance element 14 can be obtained.

Figure 5:
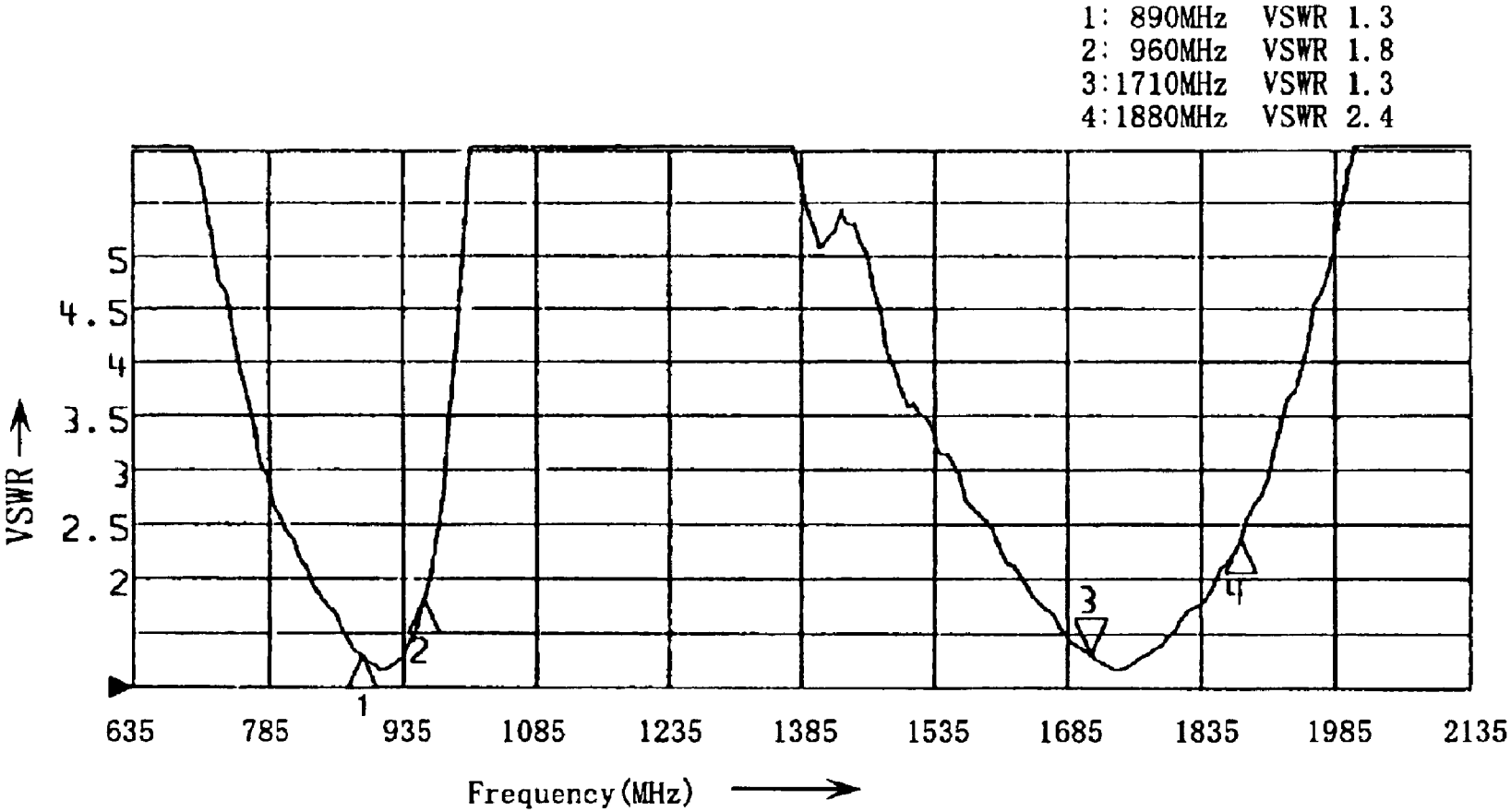
FIG. 5 illustrates a VSWR characteristic of the antenna unit which is a dual-resonance antenna of an embodiment of the present invention.

FIG. 5 shows a VSWR vs. frequency characteristic of the miniaturized dual-resonance element 14 with a total length of about 20 mm. In FIG. 5, the 900 MHz band (890–960 MHz) in the GSM system is considered as a first frequency band and the 1.7 GHz band (1710 MHz–1880 MHz) in the DCS system is considered as a second frequency band. As shown in FIG. 5, a value of about 1.3 is obtained for VSWR at the frequency of the initial end of the first frequency band and a value of about 1.8 is obtained for VSWR at the frequency of the terminal end. The worst value of VSWR in the first frequency band is about 1.8. Furthermore, a value of about 1.3 is obtained for VSWR at the frequency of the initial end of the second frequency band and a value of about 2.4 is obtained for VSWR at the frequency of the terminal end. The worst value of VSWR in the second frequency band is about 2.4. Thus, it is clear that good VSWR is obtained at the ends of the first frequency band and second frequency band.

Figure 6:
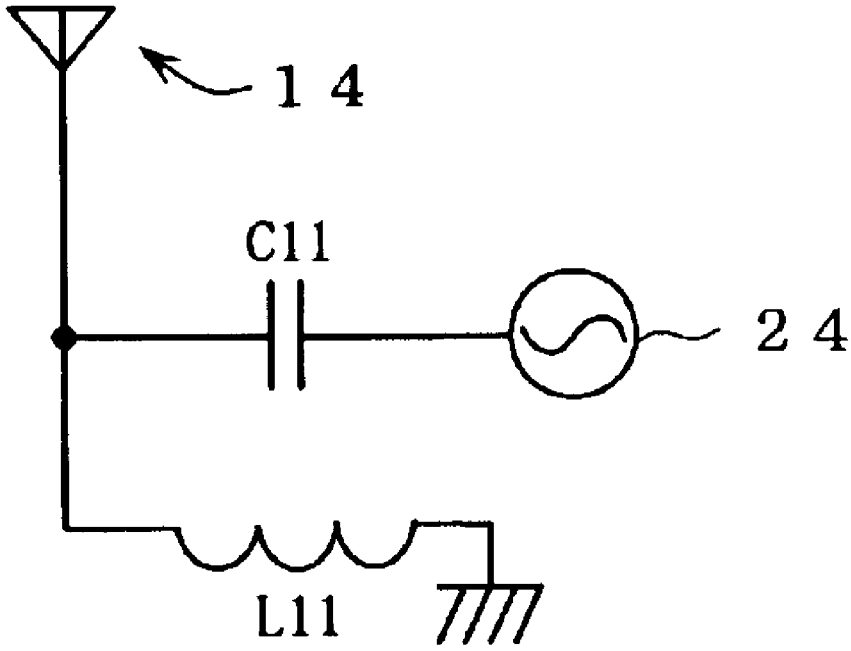
FIG. 6 illustrates an example of the matching circuit of the antenna unit which is a dual-resonance antenna of an embodiment of the present invention.

Further, the VSWR characteristic shown in FIG. 5 relates to a case in which a matching circuit shown in FIG. 6 is introduced between the dual-resonance element 14 and feeder 24. The matching circuit is composed by connecting a capacitor C11 between the dual-resonance element 14 and feeder 24 and connecting an inductor L11 between the dual-resonance element 14 and the ground. In this case, the inductor L11 is about 8.2 nH and the capacitor C11 is about 5 pF. Only single-resonance characteristic can be obtained with two reactance elements. However, since the dual-resonance element 14 by itself demonstrates a dual-resonance characteristic, good electric characteristic can be obtained with a matching circuit easily composed of two reactance elements.

Further, the matching circuit shown in FIG. 6 is an example of the above-mentioned matching circuit. The configuration of the matching circuit differs depending on specifications such as antenna length or ambient conditions of the dual-resonance element 14 such as a configuration of wireless device housing 3. Other examples of the matching circuit are shown in FIGS. 7(*a*), (*b*), and (*c*).

Figure 7A:
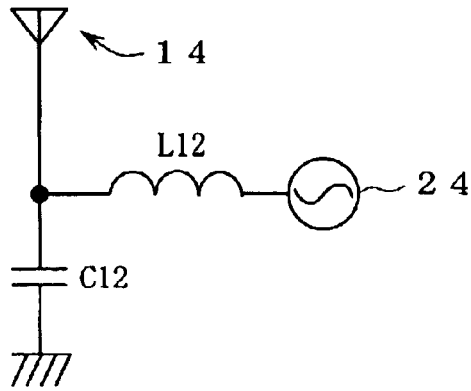
FIG. 7(*a*), FIG. 7(*b*), and FIG. 7(*c*) illustrate another example of the matching circuit of the antenna unit which is a dual-resonance antenna of an embodiment of the present invention.
Figure 7B:
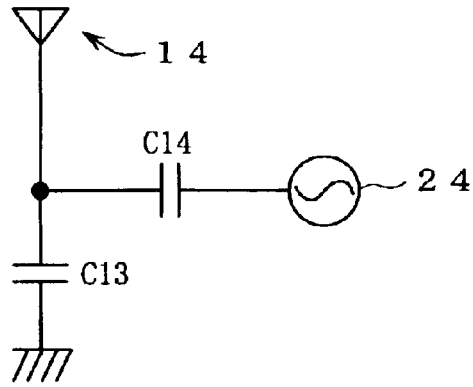
Figure 7C:
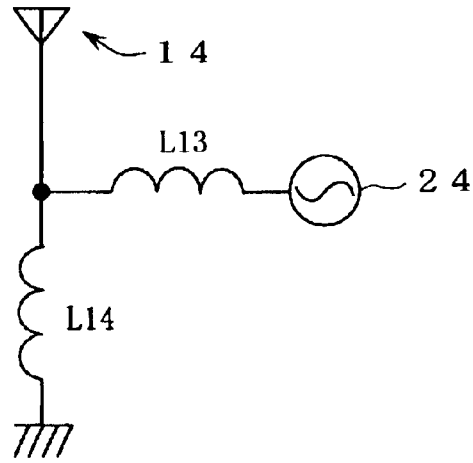

Each of the matching circuits shown FIGS. 7(*a*), (*b*), and (*c*) uses two reactance elements and has a simple configuration allowing to obtain only a single-resonance characteristic. The matching circuit shown in FIG. 7(*a*) is composed by connecting an inductance L12 between the dual-resonance element 14 and the feeder 24 and by connecting a capacitor C12 between the dual-resonance element 14 and the ground. The matching circuit shown in FIG. 7(*b*) is composed by connecting a capacitor C14 between the dual-resonance element 14 and the feeder 24 and by connecting a capacitor C13 between the dual-resonance element 14 and the ground. Further, the matching circuit shown in FIG. 7(*c*) is composed by connecting an inductance L13 between the dual-resonance element 14 and the feeder 24 and by connecting an inductance L14 between the dual-resonance element 14 and the ground.

Figure 8A:
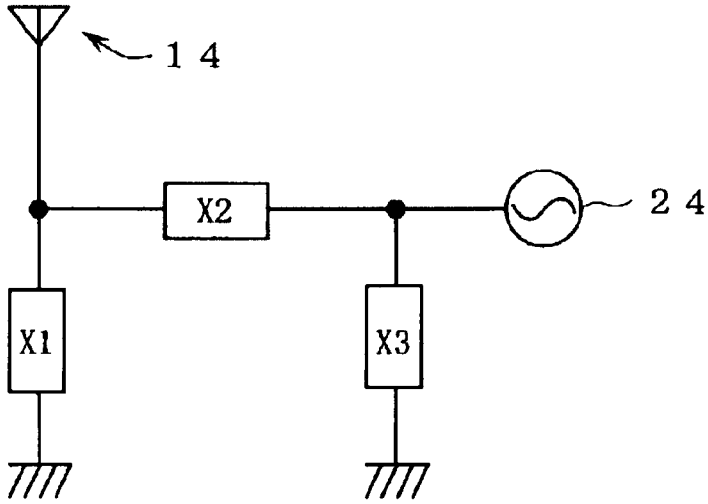
FIG. 8(*a*) and FIG. 8(*b*) illustrate still another example of the matching circuit of the antenna unit which is a dual-resonance antenna of an embodiment of the present invention.
Figure 8B:
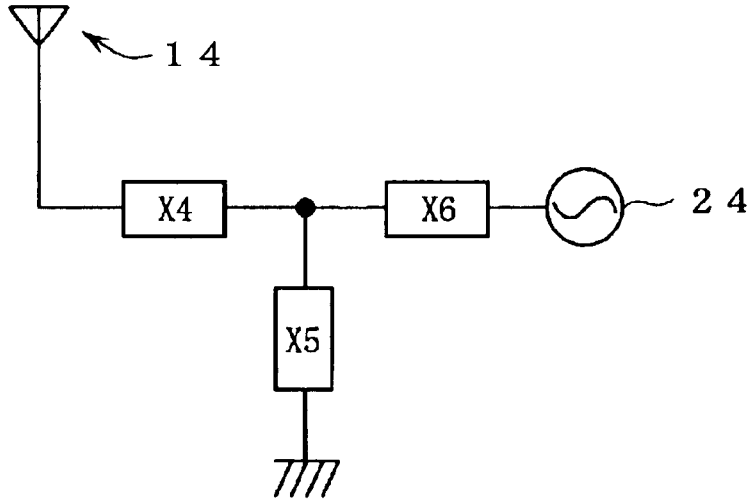
Figure 9:
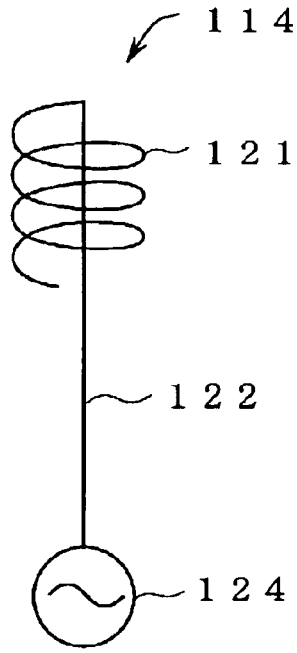
FIG. 9 Prior art
FIG. 9 illustrates a schematic configuration of the prior dual-resonance antenna.
Figure 10:
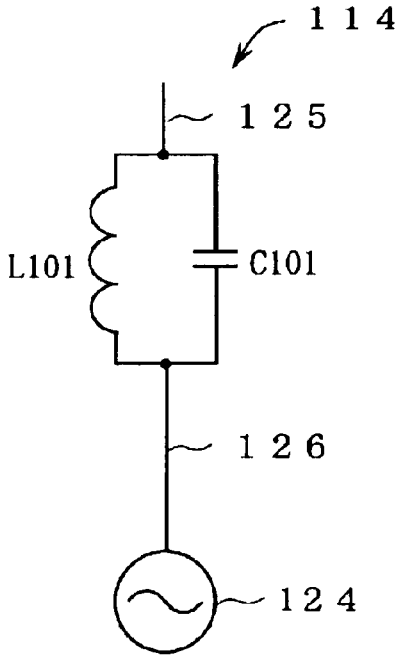
FIG. 10 Prior art
FIG. 10 illustrates an equivalent circuit of the prior dual-resonance antenna.
Figure 11:
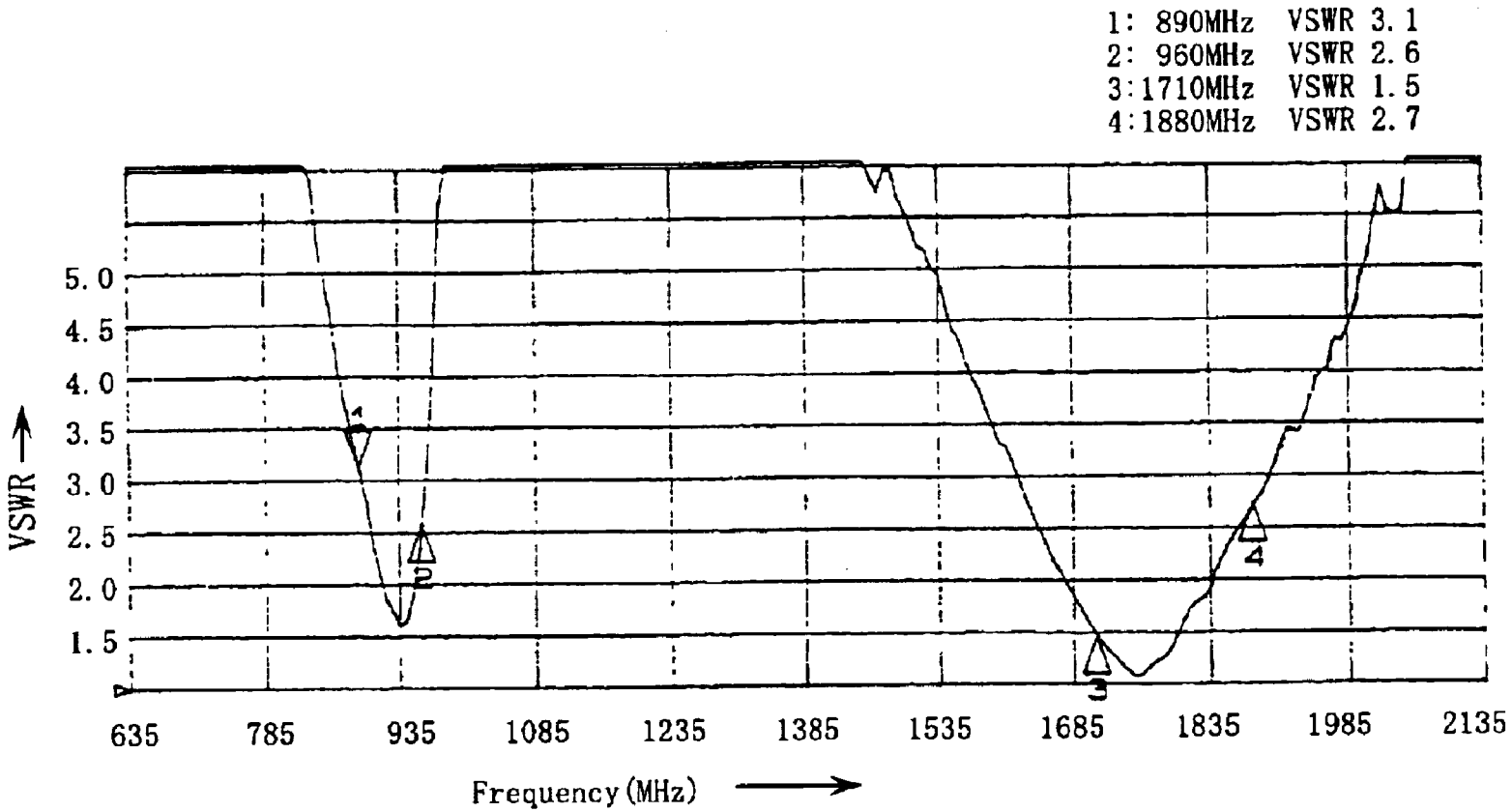
FIG. 11 illustrates a VSWR characteristic of the prior dual-resonance antenna.
Figure 12:
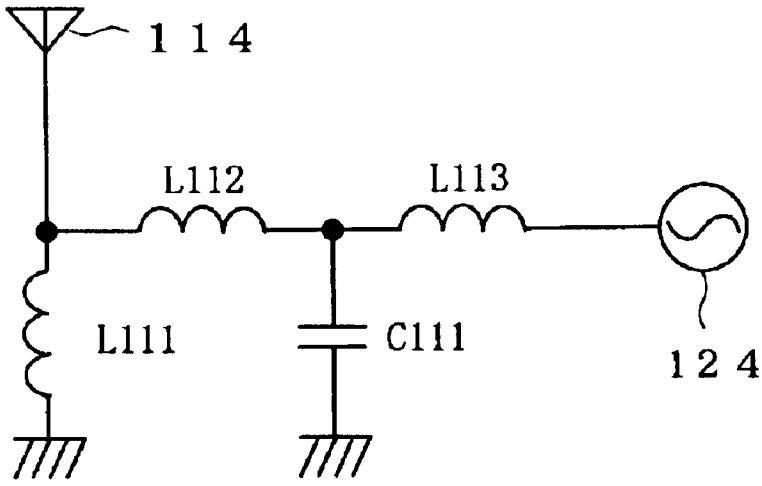
FIG. 12 Prior art
FIG. 12 illustrates a matching circuit of the prior dual-resonance antenna.

Other examples of the matching circuit are shown in FIGS. 8(*a*), (*b*).

Each of the matching circuits shown FIGS. 8(*a*), (*b*), and (*c*) uses three reactance elements and has a simple configuration allowing to obtain only a single-resonance characteristic. The matching circuit shown in FIG. 8(*a*) is a π-type circuit and is composed by connecting a second reactance X2 between the dual-resonance element 14 and feeder 24, connecting a first reactance X1 between the dual-resonance element 14 and the ground, and connecting a third reactance X3 between the feeder 24 and the ground. The matching circuit shown in FIG. 8(*b*) is a T-type circuit and is composed by connecting a fourth reactance X4 and a sixth reactance X6 in series between the dual-resonance element 14 and feeder 24, and connecting a fifth reactance X5 between the connection point of the fourth reactance X4 and sixth reactance X6 and the ground.

Of those matching circuits, any matching circuit can be employed which provides for good electric characteristics based on antenna length or ambient conditions of dual-resonance element 14.

INDUSTRIAL APPLICABILITY

In accordance with the present invention, a second coil is connected to an end portion of a connection member extending inside a first coil almost along its central axis. Therefore, the entire length of the dual-resonance antenna can be decreased and the antenna can be miniaturized. Further, the inherently necessary length of the second coil can be obtained despite such a miniaturization. Therefore, a dual-resonance antenna providing good electric characteristics can be obtained. Moreover, since a matching circuit providing a dual-resonance characteristic is not required, a simple circuit with a small number of components can be used as the matching circuit for feeding the dual-resonance antenna.

What is claimed is:

1. A dual-resonance antenna comprising:

a first coil;

a connection member obtained by bending an end portion of said first coil, wherein a relatively straight part of the end portion extends essentially along a central axis inside said first coil; and a second coil spaced apart from the first coil along the central axis and connected to the relatively straight part of the end portion of said connection member.

2. The dual-resonance antenna according to claim 1, wherein a first reactance element for impedance matching is connected between an end portion of said second coil and a feeder, and a second reactance element for impedance matching is connected between the end portion of said second coil and a ground potential.

3. The dual-resonance antenna according to claim 1, further comprising a matching circuit comprising three reactive elements which are operatively coupled between the end portion of said second coil, a ground potential, and a feeder.

4. The dual-resonance antenna according to claim 3, wherein the matching circuit comprises a π-type matching circuit.

5. The dual-resonance antenna according to claim 3, wherein the matching circuit comprises a T-type matching circuit.

* * * * *